US006301461B1

(12) United States Patent
Sirejacob

(10) Patent No.: US 6,301,461 B1
(45) Date of Patent: Oct. 9, 2001

(54) DOCTOR BLADE, TONER CARTRIDGE USING SUCH A DOCTOR BLADE AND COPYING PROCESS

(75) Inventor: Gino Sirejacob, Evergem (BE)

(73) Assignee: CF Technologies, Deinze (BE)

( * ) Notice: Subject to any disclaimer, the term of this patent is extended or adjusted under 35 U.S.C. 154(b) by 0 days.

(21) Appl. No.: 09/394,841

(22) Filed: Sep. 13, 1999

(51) Int. Cl.[7] ..... G03G 15/09
(52) U.S. Cl. ..... 399/274; 399/284
(58) Field of Search ..... 118/261; 379/249, 379/264, 273, 274, 275, 284

(56) References Cited

U.S. PATENT DOCUMENTS 5,519,472 * 5/1996 Ojima et al. ..... 399/274
5,570,166 * 10/1996 Ohzeki et al. ..... 399/274
5,682,585 * 10/1997 Yamaguchi et al. ..... 399/274
5,997,772 12/1999 Cornelius et al. .

* cited by examiner

*Primary Examiner*—Fred L Braun
*Assistant Examiner*—Hoang Ngo
(74) *Attorney, Agent, or Firm*—Darby & Darby

(57) ABSTRACT

The doctor blade consists of at least a substrate provided with an element having a face adapted for working with a magnetic roller, said element being made at least partly of an elastic material, wherein the face adapted for working with a magnetic roller has an electrical surface resistivity of less than 9.9 $10^{14}$ Ω per square and wherein the element has thickness of at least 100 μm.

79 Claims, 5 Drawing Sheets

DOCTOR BLADE, TONER CARTRIDGE USING SUCH A DOCTOR BLADE AND COPYING PROCESS

THE STATE OF THE ART

The doctor blade is used in a toner cartridge assembly for ensuring a substantially even distribution of toner on a magnetic roller.

It has been observed that during the use of a toner cartridge assembly, the efficiency of the doctor blade decreases, whereby the quality of copying and or printing documents decreases.

This problem is especially important when toner cartridge assembly are reconditioned for use.

It has been proposed to apply on the doctor blade a strip comprising a polyurethane conductive layer and a polyester layer, the said strip having a total thickness of about 30–60 μm. The polyester layer is glued on the doctor blade.

However, after 2,000–3,000 copies, the efficiency of such a doctor blade decreases, whereby the quality ofthe following copies is poor.

The invention relates to a doctor blade with an improved efficiency, as well as a strip to be glued on a substrate of a doctor blade for improving its efficiency.

BRIEF DESCRIPTION OF THE INVENTION

The invention relates to a doctor bade consisting of at least a substrate provided with an element having a face adapted for working with a magnetic roller of a machine selected from the group consisting of copier, printer and facsimile machine, said element being made at least partly of an elastic material. At least a part of the face adapted for working with a magnetic roller has an electrical surface resistivity of less than 9.9 $10^{14}$ Ω per square, advantageously less than $10^{13}$ Ω per square, preferably between $10^{7}$ and $10^{12}$ Ω per square, while at least a part of the element made at least partly of an elastic material has a thickness of at least 100 μm, for example comprised between 100 μm and 5 mm.

According to a advantageous embodiment, the doctor blade consists of at least a substrate provided with an element having face adapted for working with a magnetic roller of a machine selected from the group consisting of copier, printer and facsimile machine, said element being made at least partly of an elastic material, wherein at least a part of the element made at least partly of an elastic material has thickness of at least 100 μm, the said part having a thickness of at least 100 μm having a face adapted for working with a magnetic roller, the said face having an electrical surface resistivity of less than 9.9 $10^{14}$ Ω per square, advantageusly less than $10^{13}$ Ωper square, preferably comprised between $10^{7}$ and $10^{12}$ Ω per square, most preferably between $10^{8}$ and $10^{11}$ Ω per square.

Preferably, at least a part of the element made of at least partly of an elastic material and having a face with an electrical surface resistivity of less than 9.9 $10^{13}$ Ω per square has thickness comprised between 100 μm and 5 mm.

The element has advantageously a thickness comprised between 200 μm and 3 mm.

According to an advantageous embodiment of the doctor blade, the element comprises at least two layers, namely

- a first layer made of elastic material, said layer having a thickness of more than 100 μm, and
- a second layer covering at least partly the said first layer and being adapted for working with a magnetic roller of a copier, printer or facsimile machine, said second layer having a thickness of less than 100 μm and an electrical surface resistivity of less than 9.9 $10^{14}$ Ω per square.

Said second layer has advantageously a thickness of less than 50 μm, preferably a thickness comprised between 10 and 35 μm.

The element is advantageously made, at least partly, of elastomer material, such as polyurethane, rubber, silicone, and mixtures thereof.

According to a specific embodiment, the doctor blade comprises a flexible substrate made at least partly of a material selected from the group consisting of polyurethane, silicone, polyester, metallic blade, PVC, polycarbonate, and mictures thereof.

The said element is advantageously glued on the flexible substrate of the doctor blade. Other fixing means of the element on the flexible substrate are possible, such as mechanical fixing means. In case of mechanical fixing means, the element comprises advantageously a substantially rigid support (such as aluminum plate), the longitudinal edges of which slides into rails of the substrate.

The face adapted for working with a magnetic roller and having an electrical surface resistivity of less than 9.9 $10^{14}$ Ω per square has advantageously a resistance against abrasion measured by the ASTM-1938 abrasion test of less than 0.1 g.

According to a possible embodiment, the doctor blade comprises a flexible substrate having a free end edge, said free end edge being at least covered by the said element. Preferably, at least the part of the element covering the said free edge has a face having an electrical surface resistivity of less than 9.9 $10^{14}$ Ω per square.

According to another embodiment, the substrate is a flexible substrate having a face on which the element is attached, the said face of the substrate having a free end edge. The element is distant from said free end edge advantageously of a distance of at least 50 μm, preferably of at least 100 μm, for example of 200 μm to 600 μm.

The element comprises advantageously only a top layer containing conductive material, said layer having a thickness of less than 50 μm, for example comprised between 10 and 35 μm, and a face adapted for working with a magnetic roller having an elelctrical surface resisitivity of less than 9.9 $10^{14}$ Ω per square.

According to a preferred embodiment, the element comprises at least two layers, namely

- a first layer made at least partly of polyurethane, said layer having a thickness of more than 100 μm, and
- a second layer covering at least partly the said first layer and being adapted for working with a magnetic roller of a copier, printer or facsimile machine, said second layer being made at leat partly of polyurethane and conductive material, said second layer having a thickness of less than 100 μm and an elelctrical surface resistivity of less than 9.9 $10^{14}$ Ω per square.

The first layer has advantageously an electrical surface resistivity of more than 10 $10^{14}$ Ω per square.

According to another possible embodiment, the doctor blade comprises a flexible substrate having a free end edge, the said first layer being glued on a face of the said substrate at a distance from the said first layer so as to form a groove or recess with a depth of at least 100 μm, preferably of at least 200 μm. The said depth is advantageously comprised between 200 and 600 μm. The said groove has advantageously a width of at least 200 μm, for example comprised between 500 μm and 5 mm, but preferably comprised between 500 μm and 2 mm.

The invention relates also to a toner assemble for a copier, printer or facsimile machine, said toner aseembly comprising at least:

a container or catridge for containing toner;

a magnetic roller, and a doctor blade working with the magnetic roller, the said toner assembly having the improvement that the doctor blade consists of at least a substrate provided with an element having a face adapted for working with a magnetic roller of a machine selected from the group consisting of copier, printer and facsimile machine, said element being made at least partly of an elastic material, wherein at least a part of the face adapted for working with a magnetic roller has an electrical surface resistivity of less than 9.9 $10^{14}$ Ω per square (advantageously of less than $10^{13}$ Ω per square, preferably between $10^{7}$ and $10^{12}$ Ω per square, most preferably between $10^{8}$ and $10^{11}$ Ω per square) and wherein at least a part of the element made at least partly of an elastic material has thickness of at least 100 μm(advantageously comprised between 100 μm and 5 mm, preferably between 200 μm and 3 mm, most preferably between 200 μm and 1 mm).

The doctor blade and the element are advantageously as disclosed here before when describing the doctor blade of the invention.

Advantageously, the toner assembly ofthe invention comprises at least:

a container for containing toner;

a magnetic roller, and a doctor blade working with the magnetic roller, the said toner assembly having the improvement that the doctor blade consists of at least a substrate provided with an element having a face adapted for working with a magnetic roller of a machine selected from the group consisting of copier, printer and facsimile machine, said element being made at least partly of an elastic material, wherein at least a part of the element made at least partly of an elastic material has thickness of at least 100 μm (advantageously comprised between 100 μm and 5 mm, preferably between 200 μm and 3 mm, most preferably between 200 μm and 1 mm), the said part having a thickness of at least 100 μm having a face adapted for working with a magnetic roller, the said face having an electrical surface resistivity of less that 9.9 $10^{14}$ Ω per square (advantageously of less than $10^{13}$ Ω per square, preferably between $10^{7}$ and $10^{12}$ Ω per square, most preferably between $10^{8}$ and $10^{11}$ Ω per square).

The face adapted for working with a magnetic roller and having an electrical surface resistivity of less than 9.9 $10^{14}$ Ω per square has advantageously a resistance against abrasion measured by the ASTM-1938 abrasion test of less than 0.1 g.

According to a possible embodiment of the toner assembly, the doctor blade comprises a flexible substrate having a free end edge, said free end edge being at least covered by the said element. Preferably, at least the part of the element covering the said free edge has a face having an electrical surface resistivity of less than 9.9 $10^{14}$ Ω per square.

According to anoembodiment, the substrate is a flexible substrate having a face on which the element is attached, the said face of the substrate having a free end edge. The element is distant from said free end edge advantageously of a distance of at least 50 μm, preferably of at least 100 μm, for example of 200 μm to 600 μm.

The element comprises advantageously only a top layer containing conductive material, said layer having a thickness of less then 50 μm, for example comprised between 10 and 35 μm, and a face adapted for working with a magnetic roller having an electrical surface resistivity of less than 9.9 $10^{14}$ Ω per square.

According to a preferred embodiment of the toner cartridge, the element comprises at least two layers, namely a first layer made at least partly of polyurethane, said layer having a thickness of more than 100 μm(advantageously comprised between 100 μm and 5 mm, preferably between 150 μm and 3 mm, most preferably between 150 μm and 1 mm), and a second layer covering at least partly the said first layer and being adapted for working with a magnetic roller of a copier, printer or facsimile machine, said second layer being made at least partly of polyurethane and conductive material, said second layer having a thickness of less than 100 μm (advantageously less than 50 μm, preferably between 10 and 35 μm) and an electrical surface resistivity of less than 9.9 $10^{14}$ Ω per square (advantageously of less than $10^{13}$ Ω per square, preferably between $10^{7}$ and $10^{12}$ Ω per square, most preferably between $10^{8}$ and $10^{11}$ Ω per square).

The first layer had advantageously an electrical surface resistivity of more than 10 $10^{14}$ Ω per square.

According to another possible embodiment of the toner cartridge of the invention, the doctor blade comprises a flexible substrate having a free end edge, the said first layer being glued on a face of the said substrate at a distance from the said first layer so as to form a groove or recess with a depth of at least 100 μm, preferably of at least 200 μm. The said depth is advantageously comprised between 200 and 600 μm. The said groove has advantageously a width of at least 200 μm, for example comprised between 500 μm and 5 mm, but preferably comprised between 500 μm and 2 mm.

The invention further relates to a strip for a doctor blade, i.e. a strip to be fixed on a doctor blade, preferably to be glued on the doctor blade, for example by means of hot melt glue. The strip of the invention is made at least partly of an elastic material and has:

a first face intended to be applied on a face of the substrate, said face being provided with a means for attaching the strip on a face of the substrate, and a second face opposite said first face, said second face being adapted for working with a the said a magnetic roller of a machine selected from the group consisting of copier, printer and facsimile machine wherein at least a part of the second face has an electrical surface resistivity of less than 9.9 $10^{14}$ Ω per square (advantageously of less than $10^{13}$ Ω per square, preferably between $10^{7}$ and $10^{12}$ Ω per square, most preferably between $10^{8}$ and $10^{11}$ Ω per square) and wherein the strip has a part made at least partly of an elastic material having a thickness of at least 100 μm (advantageously comprised between 100 μm and 5 mm, preferably between 200 μm and 3 mm, most preferably between 200 μm and 1 mm).

The said means for attaching the strip on a substrate of a doctor blade is preferably a glue layer. However, possibly, the said means is a surface adapted for receiving glue or a glue layer or adapted for being pressed against a glue layer applied directly on the substrate.

According to a preferred embodiment of the strip, the strip is made at least partly of an elastic material and has:

a first face intended to be applied on a face of the substrate, said face being provided with a means for attaching the strip on a face of the substrate, and a second face opposite said first face, said second face being adapted for working with a the said a magnetic roller of a machine elected from the group consisting of copier, printer andf facsimile machine wherein the strip has a part made at least partly of an elastic material having a thickness of at least 100 μm (advantageously comprised between 100 μm and 5 mm, preferably between 200 μm and 3 mm, most preferably between 200 μm and 1 mm), at least the second face of said part having an electrical surface resistivity of less than 9.9 $10^{14}$ Ω(advantageously of less than $10^{13}$ Ω per square, preferably between $10^{7}$ and $10^{12}$ Ω per square, most preferably between $10^{8}$ and $10^{11}$ Ω per square).

According to a specific embodiment, the strip comprises at least two layers, namely a first layer made of elastic material, said layer having a thickness of more than 100 μm(advantageously comprised between 100 μm and 5 mm, preferably between 150 μm and 33 mm, most preferably between 150 μm and 1 mm), and a second layer covering at least partly the said first layer and being adapted for working with a magnetic roller of a copier, printer of facsimile machine, said second layer having a thickness of less then 100 μm (advantageously of less than 50 μm, preferably between 10 and 35 μm) and an electrical surface resistivity of less than 9.9 $10^{14}$ Ω per square (advantageously of less than $10^{13}$ Ω per square, preferably between $10^{7}$ and $10^{12}$ Ω per square, most preferably between $10^{8}$ and $10^{11}$ Ω per square).

The strip is advantageously at least partly made of elastomer material, such as polyurethane, rubber, silicone, and mixture thereof.

The means for attaching the strip on the substrate is a glue layer, an auto adhesive glue layer or a hot melt glue layer.

Preferably, the second face adapted for working with a magnetic roller and having an electrical surface resistivity of less than 9.9 $10^{14}$ Ω per square has a resistance against abrasion measured by the ASTM-1938 abrasion test of less than 0.1 g.

According to specific embodiments, the strip of the invention comprises at least two layers, namely a first layer made at least partly of polyurethane, said layer having a thickness of more than 100 μm(advantageously comprised between 100 μm and 5 mm, preferably between 150 μm and 3 mm, most preferably between 150 μm and 1 mm), and a second layer covering at least partly the said first layer and being adpated for working with a magnetic roller of a copies, printer or facsimile machines, said second layer being made at least partly of polyurethane and conductive material, said second layer having a thickness of less than 100 μm (advantageously of less than 50 μm, preferably between 10 and 35 μm) and an electrical surface resistvitiy of less than 9.9. $10^{14}$ Ω per square(advantageously of less than $10^{13}$ Ω per square, preferably between $10^{7}$ and $10^{12}$ Ω per square, most preferably between $10^{8}$ and $10^{11}$ Ω per square).

The first layer has preferably an electrical surface resistivity of more than 10 $10^{14}$ Ω per square.

According to a further embodiment of a strip of the invention, the strip comprises at least one layer made at least partly of elastic material and conductive material, said layer having a thickness of more than 100 μm(advantageously comprised between 100 μm and 5 mm, preferably between 150 μm and 3 mm, most preferably between 150 μm and 1 mm), and layer having an electrical surface resistivity of less than 9.9 $10^{14}$ Ω per square(advantageously of less than $10^{13}$ Ω per square, preferably between $10^{7}$ and $10^{12}$ Ω per square, most preferably between $10^{8}$ and $10^{11}$ Ω per square).

The elastic material is advantageously silicone, rubber, polyurethane or mixtures thereof, possible mixed with polyolefin.

The said layer has advantageously a surface intended to work with a magnetic roller, said surface having a resistance against abrasion measured by the ASTM-1938 abrasion test of less than 0.1 g.

The said layer is advantageously provided on its face to be applied on a substrate of the doctor blade with a glue layer.

Still a further subject matter of the invention is a process for printing or copying a document by means of a printer, copier or facsimile machine, in which at least:

toner is transferred on a magnetic roller;

a doctor blade works with the said magnetic roller for distributing toner on the magnetic roller;

toner distributed by the doctor blade of the magnetic roller is transferred on a charge sensible element, and toner transferred on the charge sensible element is transferred on a support.

Said process being improved by the fact that the doctor blade is a doctor blade of the invention or is a doctor blade, the substrate of which is provided with a strip of the invention. Said doctor blade and strip are disclosed here above in the present specification. The said process contains therefore one or more characteristics of the doctor blade and strip of the invention.

Still a further subject matter of the invention is a process for reconditioning a used doctor blade, in which a strip of the invention is glued on the substrate of the doctor blade. The said strip is disclosed herebefore in the present specification.

According to an embodiment of the process of the invention, the strip is glued on the substrate so that the strip covers the free end edge of the substrate.

According to another embodiment of the process of the invention, the strip is glued on a face of the substrate adjacent to the free end edge. Advantageously, the strip is glued on the said face so that an edge of the strip is adjacent to said free end edge of the substrate, but distant from said free end edge, for example of a distance of at least 50 μm, advantageously of at least 100 μm, preferably of 200 μm to 600 μm.

According to a specific embodiment, prior to the gluing of the strip on the substrate of the doctor blade, the shape of which was distorted during its use, the substrate is submitted to a heat treatment and to a pressure (advantageously with a bending) for restoring substantially the shape of the substrate of the doctor blade before its use.

According to another possible embodiment, a strip is first glued on the substrate of the doctor blade, for example a polyurethane substrate, the said substrate having a shape distorted during its prior use. The substrate is thereafter submitted to a heat treatment and to a pressure (advantageously a bending) for restoring substantially the shape of the substrate of the doctor blade before its use.

The second face or layer of the element of the doctor blade or of the strip of the invention is conductive due to the presence of conductive material, such as:

particles or fibers containing or provided with a layer containing: Au,Zn,Al, Ag,Ni,Cu,Pd,Pt,C, graphite, conductive metal oxides such as $SnO_2$,$In_2O_3$,$Sb_2O_3$, ITO (Indium tin oxide),$TiO_2$ or a mixture thereof, and/or conductive polymers or copolymers, such as polyacetylene, polypyrrole, polyaniline, polyphenylene, and mixtures thereof.

Carbon particles, such as expanded carbon particles, are suitable. When using particles, such as carbon particles, the particles have advantageously a diameter lower than 25 μm, preferably lower than 10 μm, most preferably lower than 5 μm, a density lower than 350 g/l (weight of 1 liter particles in the form of a powder), for example between 100 and 250 g/l, and a surface area (BET) greater than 75 $m^2/g$, for example between 100 and 250 $m^2/g$.

The conductive layer or the face working with the magnetic roller (for example the second layer of specific embodiment of the element of the doctor blade of the invention or of the strip of the invention) is advantageously made of a polymer or copolymer, preferably a thermoplastic polymer or copolymer having a melting point higher than 125° C., preferably higher than 150° C., said polymer or copolymer being conductive or being mixed with conductive material(s). Preferably, the said conductive layer contains at least polyurethane, as polymer or copolymer with for example polyester, or in mixture with another polymer, preferably a compatible polymer (or copolymer) or a polymer (or copolymer) which can be mixed with the polyurethane polymer or copolymer. Preferably the polyurethane polymer or copolymer is a thermoplastic polyurethane.

The amount of conductive material present in the said second layer is adjusted so as to obtain the desired conductivity (i.e., a low resistivity).

When the element of the doctor blade of the invention or the strip of the invention comprises two superposed layers, a conductive layer (second layer) and a conductive or not conductive layer (first layer), the said first layer is advantageously not conductive and contains preferably at least polyurethane, in the form of a polymer or a copolymer or in the form of a mixture with another polymer or copolymer. The first layer is advantageously a thermoplastic layer.

The first and/or second layer can possibly contain other additives or particles, in case these additives do not impair the requested property of the layer(s). For example, the first and/or second layer can possibly contain some used toner particles.

The second face or layer of the doctor blade or strip or doctor blade used in the process of the invention is most preferably water impermeable and has preferably a resistance against abrasion measured by the ASTM-1938 abrasion test of less than 0.1 g.

DESCRIPTION OF PREFERRED EMBODIMENTS

Figure 1:
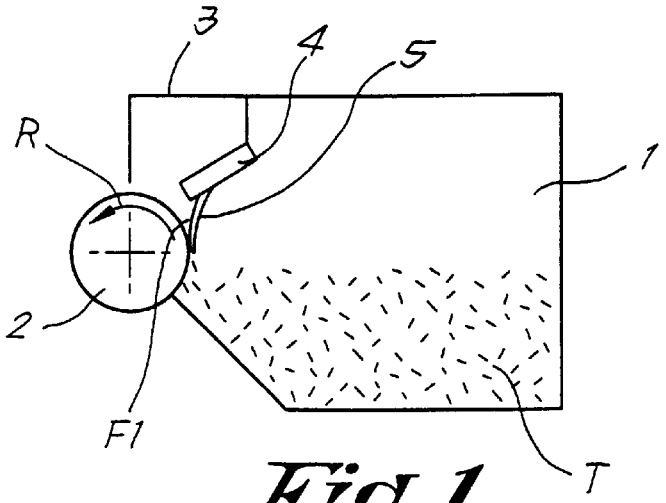
FIG. 1 is a schematic view of a first toner cartridge assembly.

The toner cartridge assembly of FIG. 1 comprises:

- a container 1 for containing toner particles T, said container being provided with an opening 1A;
- a magnetic roller 2 attached to the container 1 by means of arms 3, said roller being able to rotate (R) in front of the said opening 1A;
- a support 4 attached to the container 1;
- a flexible doctor blade 5 mounted on the support 4, the said doctor blade working with the magnetic roller, so as to obtain a correct distribution of toner particles on the magnetic roller, as well as a correct thickness of the layer of toner particles on the magnetic roller.

Figure 3:
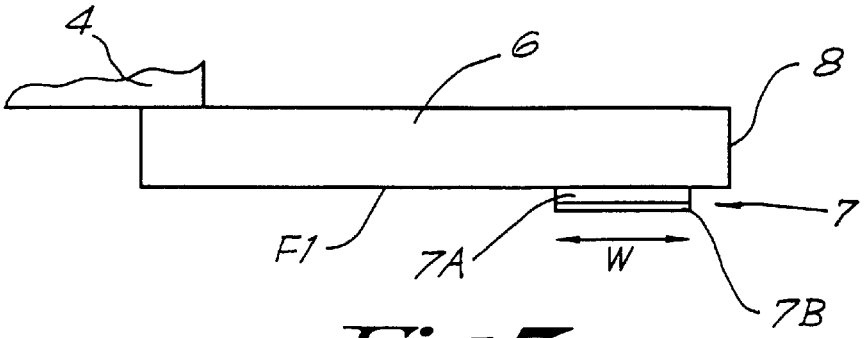
FIG. 3 is an enlarged cross-section view of the doctor blade of the toner assembly of FIG. 1.

FIG. 3 is an enlarged view of the doctor blade 5. Said doctor blade consists of a flexible substrate 6 (for example of polyurethane blade or a silicone blade), the face F1 intended to be directed towards the magnetic roller 2 being provided with a strip 7 comprising: a polyurethane layer 7A having a thickness of 250 μm and an elelctrical surface resistivity of more than 10 $10^{14}$ Ω per square, and a polyurethane layer 7B having a thickness of 30 μm and an electrical surface resistivity of about 10 $10^{11}$ Ω per square. The width W of the strip is advantageously comprised between 3 mm and 10 mm, for example 4–5 mm.

The electrical surface resistivity is advantageously measured in accordance to the ASTM method D 257-93. The surface resistivity is suitable in the present case as it performs a quality conformance check of the conductive layer.

The second layer 7B was water impermeable and had a resistance against abrasion measured by the ASTM-1938 abrasion test of less than 0.1 g.

In order to obtain the required resistivity for the second layer 7B, conductive expanded carbon black particles were added to the polyurethane, said carbon black particles having a diameter lower than 15 μm, a density of about 200 g/l (1 liter of carbon black powder weights 200 g), and a surface area (BET) of about 150 $m^2/g$.

The strip 7 is glued on the face F1 at a distance from the free end edge 8 of the flexible substrate 6. A groove or recess 9 having a depth of about 280 μm (total thickness of the strip) is formed between the strip 7 and the free end 8 on the said face F1. When using such a doctor blade, toner particles fill at least partly said recess or groove, said toner particles forming a scraping protuberance ensuring a scraping action as well a protection against an accidental removal of the strip.

The doctor blade 7 is flexible and is bent when mounted in the toner cartridge assembly of FIG. 1. The doctor blade is therefore pressed towards the magnetic roller.

Figure 2:
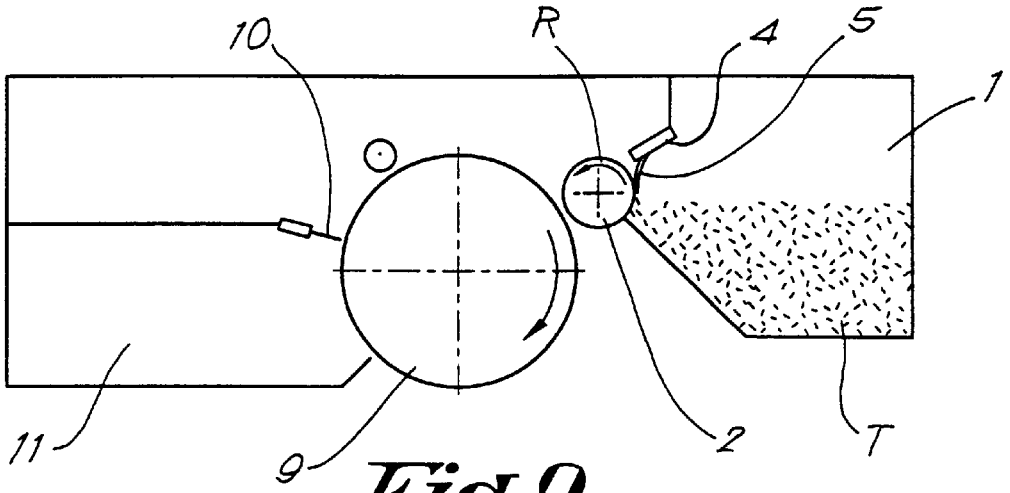
FIG. 2 is a schematic view of another toner cartridge assembly.

The toner cartridge assembly of FIG. 2 is similar to the toner assembly of FIG. 1, except that the toner assembly is further provided with a charge sensible drum 9 (such as a photo sensible drum), a scraper 10 for removing residual toner present on the drum 9 after the transfer of toner on a paper sheet, a container 11 for collecting the removed toner by the scraper 10, and a primary charge roller 12. The doctor blade used in this toner assembly was the same as for the toner assembldy of FIG. 1.

Tests have been carried out by using the toner assemblies of FIGS. 1 and 2 on copiers. These tests have shown that when using such a doctor blade, the quality of the copies is still excellent after 25,000 copies.

Figure 4:
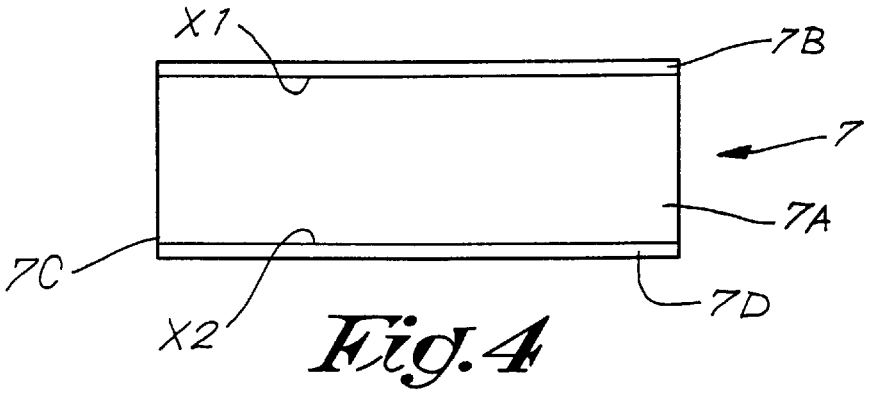
FIG. 4 is an enlarged cross-section view of a strip of the invention.

FIG. 4 shows a cross section view of a strip of the invention. Said strip 7 comprises:

- a polyurethane layer 7A having a thickness of 250 μm and an electrical surface resistivity of more than 10 $10^{14}$ Ω per square,
- a polyurethane layer 7B having a thickness of 30 μm and an electrical surface resistivity of about 10 $10^{10}$ Ω per square suitable to be used, said layer 7B covering the face X1 of the layer 7A, a glue layer (preferably a self adhesive glue, but possibly a hot melt glue) 7C covering the face X2 (opposite to the face X1), and possibly a protective sheet 7D (such as a siliconized paper) intended to be removed before applying the strip on the doctor blade.

The polyurethane layers 7A,7B can be prepared from a mixture containing a polyisocyanate and a polyol. When the layer has to be conductive, conductive materials (such as conductive polymer, conductive particles, carbon black particles, etc.) are added to the mixture. The preparation of polyurethane films, bands or layers (conductive or not) can be made by using the methods disclosed in U.S. Pat. Nos. 3,933,5448; 3,830,656; 5,855,820; EP 0 786 422 and/or EP 0 337 228, the content by which is incorporated herewith by reference. When the layer has to be non conductive, no conductive materials are added in the process of U.S. Pat. Nos. 3,933,5448; 3,830,656; 5,855,820; EP 0 786 422. Advantageously, the polyurethane is however a thermoplastic polyurethane.

The polyurethane layer 7A ca possibly be a foam layer.

FIGS. 5 to 11 are cross section views of strips of the invention.

Figure 5:
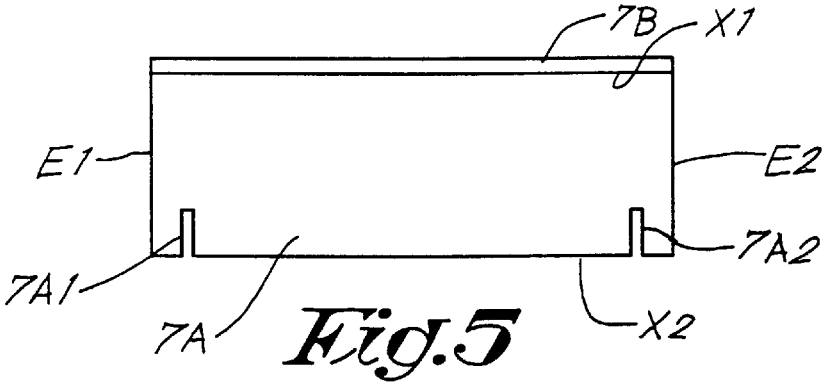
FIGS. 5 to 11 are views similar to that of FIG. 4, but of other embodiments of strips according to the invention.

The strip of FIG. 5 is similar to the strip of FIG. 4, except that the layer 7A is provided with longitundinal grooves 7A1, 7A2 extending along the face X2, so as to increase the flexibility of the strip along its longitundinal edges E1,E2.

Figure 6:
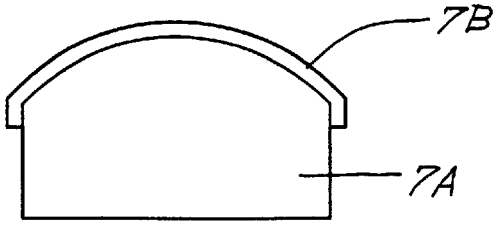
Figure 7:
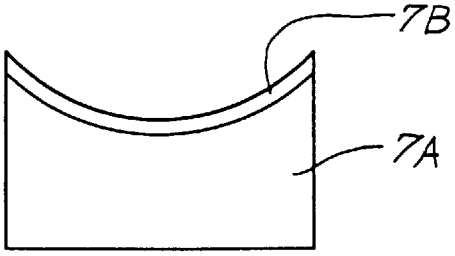

The strip 7 of FIG. 6 is similar to the strip of FIG. 4, except that the layer 7A has a convex cross section. In the strip of FIG. 7, the layer 7A has a concave cross section.

Figure 8:
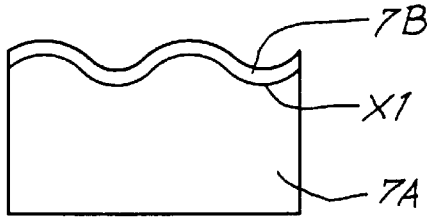

The strip of FIG. 8 has a layer 7A with a cross section with a wave shape along its face X1.

Figure 9:
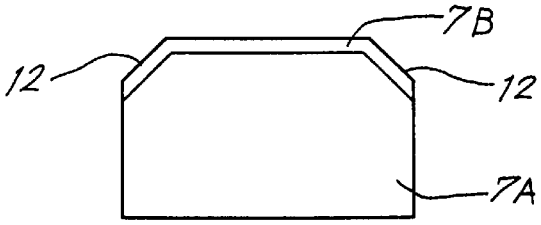

The strip of FIG. 9 has a cross sectionhaving inclined edges 12.

Figure 10:
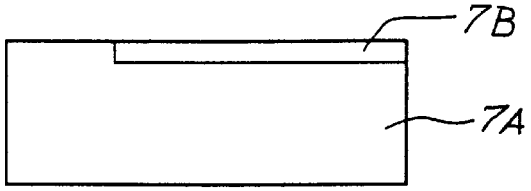
Figure 11:
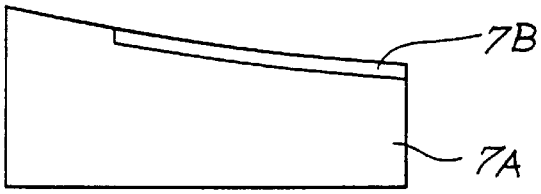

The strip of FIG. 10 has a substantially rectangular cross section, the layer 7B being located in a recess of the layer 7A. The strip of FIG. 11 is similar to the strip of FIG. 10, except that the thickness of the strip along the edge E1 is greater than the thickness along the edge E2. Advantageously the decrease of thickness from the edge E1 towards the edge E2 is continuous.

Figure 12:
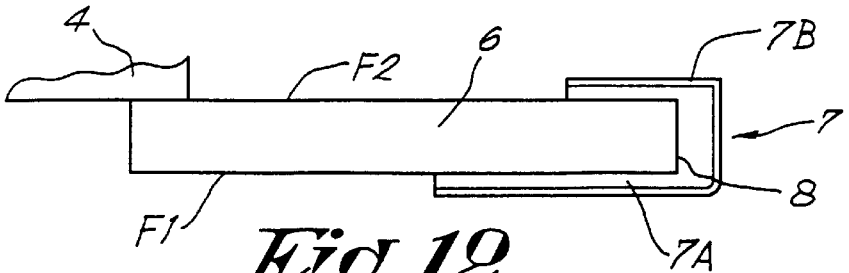
FIG. 12 is an enlarged cross-section of a specific embodiment of a doctor blade of the invention.

The doctor blade of FIG. 12 is similar to the doctor blade of FIG. 3, except that the strip 7 covers part of the face F1, the free end 8 and part of the face F2 of the substrate 6. This embodiment is advantageous, as there is no risk that the strip could be scratched away during its working and as the rigidity of the free end of the doctor blade is increased.

Figure 13:
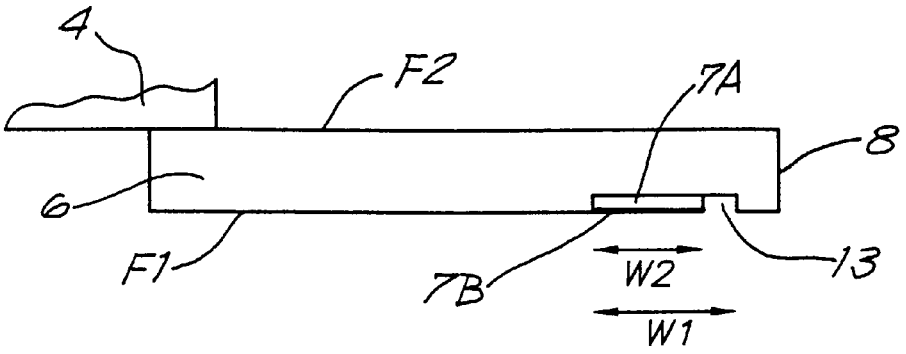
FIGS. 13 to 15 are enlarged cross-section views of still other embodiments of doctor blade.

The doctor blade of FIG. 13 comprises a substate 6 provided with a longitudinal recess 13 in which a strip 7 is placed. Advantageously the recess 13 has a width w1 smaller than the width w2 of the strip 6. Advantageously, the thickness of the strip 7 is greater than the septh of the recess, whereby the layer 7B is located below the face F1 when said face is horizontal and directed downwardly.

Figure 14:
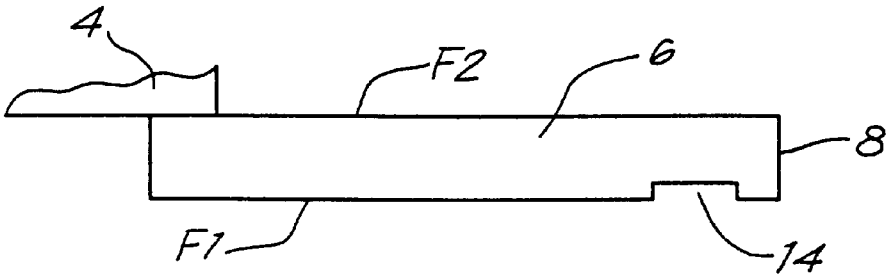

FIG. 14 is a cross section view of a flexible doctor blade, which is provided in the neighborhood of the free end 8, with a longitudinal groove or recess 14. Said groove or recess 14 is advantageously substantially parallel to the free end of the doctor blade. The width of the groove or recess is advantageously greater than 100 $\mu$m, preferably comprised between 200 $\mu$m and 3 mm, while the depth of the groove or recess is advantageously greater than 50 $\mu$m, preferably comprised between 100 $\mu$m and 1 mm. Preferably, the depth of the groove or recess is less than or equal to about 50% of the total thickness of the substrate 6 of the doctor blade 5.

The recess or groove is advantageously distant from the free end of the substrate. Advantageously, the recess or groove 14 is located at a distance greater than 500 $\mu$m, preferably comprised between 500 $\mu$m and 3 mm from the free end.

The recess or groove is intended to be directed towards the magnetic roller. When using such a doctor blade in a toner cartridge asembly, toner particles fill the groove or recess and form a scraping means made of toner particles. Instead of having a rectangular cross section, the groove or recess may have other cross-sections, such as semicircular, trapezoidal, triangular, etc. Advantageously, the groove or recess 1 extends between two substantially parallel edges e3,e4 on the face F1 of the substrate.

Figure 15:
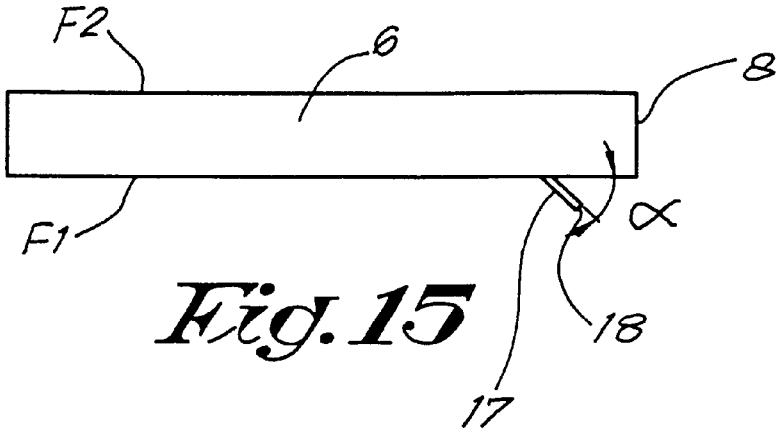

FIG. 15 shows in cross-section another embodiment of a doctor blade. In this embodiment, the recess or space 14 for receiving toner particles is formed by a longitundinal finger 17 present on the face F1 of the substrate 6, preferably in the neighborhood of the free end 8. The free end 18 of the said finger is advantageously distant form the face F1 of a distance of at least 200 $\mu$m, preferably of at least 500 $\mu$m (for example comprised between 500 $\mu$m and 3 mm). Such a finger 16 is advantageously inclined with respect to the face with an angle $\alpha$ comprised between 15 and 60°, so that the opening of the longitudinal space 14 is directed towards the end 8.

The finger 17 can be replaced by a strip fixed or glued on the face F1.

Figure 16:
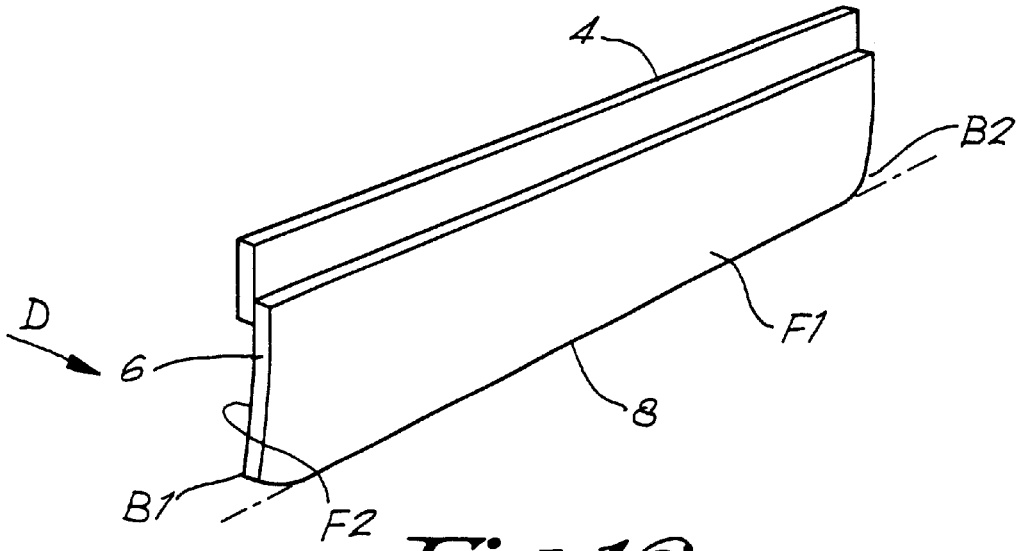
FIGS. 16 and 17 are views explaining the reconditioning of a doctor blade.
Figure 17:
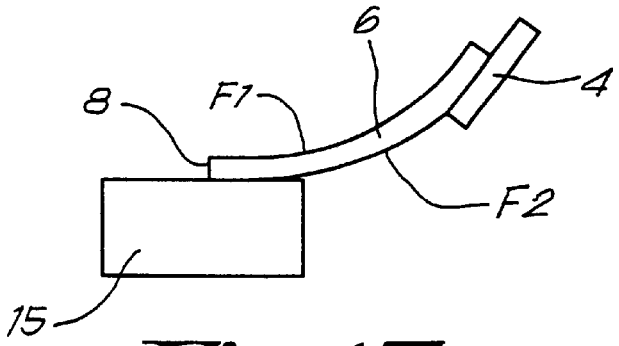

For reconditioning a doctor blade (for example made of polyurethane) showing a permanent bending B1,B2 (bending which is residual or due to the use of the doctor blade in a toner cartridge) along its lateral edges L1,L2 after a prolonged use, it has been observed that a heat treatment of the doctor blade combined with or followed by a bending in a direction D opposite to the direction of the permanent bending could restore the property of the face F1 of the substrate. This treatment is sufficient for obtaining back a substantially flat surface for the face F1 or a surface corresponding substantially to the surface of the substrate before use. For example, the said reconditioning is made by pushing the part of the face F2 of the substrate adjacent to the free end 8 on a heating element 15 so that the substrate 6 is bent in a direction opposite to the direction of the permanent bending, while being heated. The heated step is advantageously substantially sufficient for softening at least substantially the part(s) of the substrate having a permanent bending due to the use of the doctor blade. However, preferably, at least the part of the substrate 6 adjacent to the free end 8 is heated. (see FIGS. 16 and 17)

Advantageously, after the heat and bending treatments, a strip 7 of the invention is placed onh the face F1 of the substrate. It is however also possible to first fix a strip 7 on the face F1 of the substrate, and then to apply the heat and bending treatments.

Figure 18:
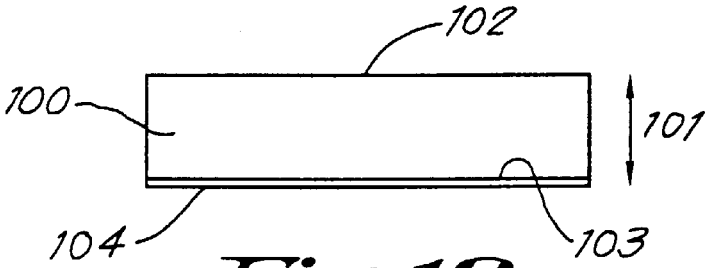
FIG. 18 is a further view of a strip according to the invention.

FIG. 18 is an enlarged view of a further embodiment of a strip of the invention. The strip 100 is a mono layer strip made essentially of elastic material and conductive material such as carbon black particles. The said layer has a thickness 101 of more than 100 $\mu$m, for example about 200 $\mu$m. The said layer has an electrical surface resistivity of about and $10^{10}$ $\Omega$ per square).

As elastic material, polyurethane was used. However, other elastic material can be used, such as silicone, rubber, polyurethane or mixtures thereof, possibly mixed with polyolefin or other polymer or copolymer.

The mono layer strip was impermeable to water and had an outer surfce 102 intended to work with a magnetic roller, said surface having a resistance against abrasion measured by the ASTM-1938 abrasion test of less than 0.1 g.

The said mono layer is advantageously provided on its face 103 to be applied on a substrate of the doctor blade with a glue layer 104.

What I claim is:

1. A doctor blade consisting of at least a substrate provided with an element having a face adapted for contact with interposition of toner particles a magnetic roller of a machine selected from the group consisting of copier, printer and facsimile machine, said element comprising at least two layers, namely:

a first layer made of elastic material, said first layer having a thickness of more than 100 $\mu$m and a resistivity of more than 10 $10^{14}$ $\Omega$ per square, and a second layer covering at least partly the said first layer and having a face adapted for contacting with interposition of toner particles a magnetic roller, said second layer having a thickness of less than 100 $\mu$m and an electrical surface resistivity of less than $10^{13}$ $\Omega$ per square.

2. The doctor blade of claim 1, in which the second layer has an electrical surface resistivity comprised between $10^7$ and $10^{12}$ $\Omega$ per square.

3. The doctor blade of claim 1, in which the second layer has an electrical surface resistivity comprised between $10^8$ and $10^{11}$ $\Omega$ per square.

4. The doctor blade of claim 1, in which the second layer has a thickness of less than 50 $\mu$m.

5. The doctor blade of claim 1, in which the second layer has a thickness comprised between 10 and 35 $\mu$m.

6. The doctor blade of claim 1, in which the element is at least partly made of elastomer material selected among the group consisting of polyurethane, rubber, silicone, and mixture thereof.

7. The doctor blade of claim 1, in which the substrate is a substrate made at least partly of a material selected from the group consisting of polyurethane, silicone, polyester, metallic blade, PVC, polycarbonate, and mixtures thereof, the said element being attached to the said substrate.

8. The doctor blade of claim 7, in which the substrate is flexible and has a free end edge, said free end edge being at least covered by said element.

9. The doctor blade of claim 8, in which the free edge is covered by a part of the element which has a second layer having an electrical surface resistivity of less than $10^{13}$ $\Omega$ per square.

10. The doctor blade of claim 1, in which the element is glued on the substrate.

11. The doctor blade of claim 1, in which the second layer of the element comprises conductive material, said second layer having a thickness of less than 50 $\mu$m.

12. A doctor blade consisting of at least a substrate provided with an element having a face adapted for contacting with interposition of toner particles a magnetic roller of a machine selected from the group consisting of copier, printer and facsimile machine, said element comprising at least two layers, namely a first layer made of elastic material, said first layer having a thickness of more than 100 $\mu$m and a resistivity of more than 10 $10^{14}$ $\Omega$ per square, and a second layer covering at least partly the said first layer and having a face adapted for contacting with interposition of toner particles a magnetic roller, said second layer having a thickness of less than 100 $\mu$m, an electrical surface resistivity of less than $10^{13}$ $\Omega$ per square and a resistance against abrasion measured by the ASTM-1938 abrasion test of less than 0.1 g.

13. A doctor blade consisting of at least a substrate having a free end edge and provided with an element having a face adapted for contacting with interposition of toner particles a magnetic roller of a machine selected from the group consisting of copier, printer and facsimile machine, said element, which is made at least partly of an elastic material, having at least partly a thickness of 100 $\mu$m and comprising a layer having a face adapted for contacting with interposition of toner particles a magnetic roller, said layer having an electrical surface resistivity of less 9.9 $10^{14}$ $\Omega$ per square, in which the element is distant from said free end edge of the substrate.

14. The doctor blade of claim 13, in which the element is distant from said free edge of a distance of at least 50 $\mu$m.

15. A toner assembly for a copier, printer or facsimile machine comprising at least:

a container for containing toner;

a magnetic roller, and a doctor blade working with the magnetic roller, the said toner assembly having the improvement that the doctor blade consists of at least a substrate provided with an element having a face adapted for contacting with interposition of toner particles the magnetic roller, said element comprising at least two layers, namely a first layer made of elastic material, said first layer having a thickness of more than 100 $\mu$m and a resistivity of more than 10 $10^{14}$ $\Omega$ per square, and a second layer covering at least partly the said first layer and having a face adapted for contacting with interposition of toner particles the magnetic roller, said second layer having a thickness of less than 100 $\mu$m and an electrical surface resistivity of less than $10^{13}$ $\Omega$ per square.

16. The toner assembly of claim 15, in which a part of the second layer has an electrical surface resistivity comprised between $10^7$ and $10^{12}$ $\Omega$ per square.

17. The toner assembly of claim 15, in which a part of the second layer has an electrical surface resistivity comprised between $10^8$ and $10^{11}$ $\Omega$ per square.

18. The toner assembly of claim 15, in which the element is made at least partly of an elastic material and has a thickness comprised between 200 $\mu$m and 3 mm.

19. The toner assembly of claim 15, in which the second layer has a thickness of less than 50 $\mu$m.

20. The toner assembly of claim 15, in which the second layer has a thickness comprised between 10 and 35 $\mu$m.

21. The toner assembly of claim 15, in which the element is at least partly made of elastomer material.

22. The toner assembly of claim 15, in which the element is at least partly made of elastomer material selected among the group consisting of polyurethane, rubber, silicone, and mixture thereof.

23. The toner assembly of claim 15, in which the substrate is a substrate made at least partly of a material selected from the group consisting of polyurethane, silicone, polyester, metallic blade, PVC, polycarbonate, and mixtures thereof, the said element being attached to the said substrate.

24. The toner assembly of claim 15, in which the substrate is flexible and has a free end edge, said free end edge being at least covered by the said element.

25. The toner assembly of claim 24, in which the said free edge is covered by a part of the element which comprises a second layer.

26. The toner assembly of claim 15, in which the element is glued on the substrate.

27. The toner assembly of claim 15, in which the toner assembly is not provided with connecting means for connecting the doctor blade to a voltage applying means.

28. A toner assembly for a copier, printer of facsimile machine comprising at least:

a container for containing toner;

a magnetic roller, and a doctor blade working with the magnetic roller, the said toner assembly having the improvement that the doctor blade consists of at least a substrate provided with an element having a face adapted for contacting with interposition of toner particles the magnetic roller, said element comprising at least two layers, namely a first layer made of elastic material, said first layer having a thickness of more than 100 $\mu$m and a resistivity of more than 10 $10^{14}$ $\Omega$ per square, and a second layer covering at least partly the said first layer and having a face adapted for contacting with interposition of toner particles the magnetic roller, said second layer having a thickness of less than 100 $\mu$m and an electrical surface resistivity of less than $10^{13}$ $\Omega$ per square and a resistance against abrasion measured by the ASTM-1938 abrasion test of less than 0.1 g.

29. The toner assembly of claim 28, in which the toner assembly is not provided with connecting means for connecting the doctor blade to a voltage applying means.

30. A toner assembly for a copier, printer or facsimile machine comprising at least:

a container for containing toner;

a magnetic roller, and a doctor blade working with the magnetic roller, the said toner assembly having the improvement that the doctor blade consists of at least a substrate provided with an element having a face adapted for contacting with interposition of toner particles the magnetic roller, said element, which is made at least partly of an elastic material, having at least partly a thickness of 10 $\mu$m and comprising a layer having a face adapted for contacting with interposition of toner particles of magnetic roller, said layer having an electrical surface resistivity of less 9.9 $10^{14}$ $\Omega$ per square, in which the element is distant from said free end edge of the substrate.

31. The toner assembly of claim 30, in which the element is distant from said free edge of a distance of at least 50 $\mu$m.

32. The toner assembly of claim 30, in which the toner assembly is not provided with connecting means for connecting the doctor blade to a voltage applying means.

33. A toner assembly for a copier, printer or facsimile machine comprising at least:

a container for containing toner;

a magnetic roller, and a doctor blade working with the magnetic roller, the said toner assembly having the improvement that the doctor blade consists of at least a substrate provided with an element having a face adapted for contacting with interposition of toner particles the magnetic roller, said element comprising at least two layers, namely a first layer made at least partly of polyurethane, said first layer having a thickness of more than 100 $\mu$m and a resistivity of more than 10 $10^{14}$ $\Omega$ per square, and a second layer covering at least partly the said first layer and having a face adapted for contacting with interposition of toner particles a magnetic roller, said second layer made at least partly of polyurethane and conductive material having a thickness of less than 100 $\mu$m and an electrical surface resistivity of less than $10^{13}$ $\Omega$ per square.

34. The toner assembly of claim 33, in which the second layer has a resistance against abrasion measured by the ASTM-1938 abrasion test of less than 0.1 g.

35. The toner assembly of claim 33, in which the toner assembly is not provided with connecting means for connecting the doctor blade to a voltage applying means.

36. A strip for coating at least partly a face of a substrate of a doctor blade intended to work with a magnetic roller of a machine selected from the group consisting of copier, printer and facsimile machine, said strip comprising at least two layers, namely a first layer made of elastic material and provided with means for attaching it on a face of the substrate, said first layer having a thickness of more than 100 $\mu$m and a resistivity of more than 10 $10^{14}$ $\Omega$ per square, and a second layer covering at least partly the said first layer and having a face adapted for contacting with interposition of toner particles the magnetic roller, said second layer having a thickness of less than 100 $\mu$m and an electrical surface resistivity of less than $10^{13}$ $\Omega$ per square.

37. The strip of claim 36, in which the second layer has an electrical surface resistivity comprised between $10^7$ and $10^{12}$ $\Omega$ per square.

38. The strip of claim 36, in which the second layer has an electrical surface resistivity comprised between $10^8$ and $10^{11}$ $\Omega$ per square.

39. The strip of claim 36, in which the strip has a thickness comprised between 200 $\mu$m and 3 mm.

40. The strip of claim 36, in which the second layer has a thickness of less than 50 $\mu$m.

41. The strip of claim 36, in which the second layer has a thickness comprised between 10 and 35 $\mu$m.

42. The strip of claim 36, which is at least partly made of a elastomer material.

43. The strip of claim 36, which is at least partly made of elastomer material selected among the group consisting of polyurethane, rubber, silicone, and mixture thereof.

44. The strip of claim 36, in which the means for attaching the strip on the substrate is a glue layer.

45. The strip of claim 36, in which the second layer has a resistance against abrasion measured by the ASTM-1938 abrasion test of less than 0.1 g.

46. A strip for coating at least partly a face of a substrate of a doctor blade intended to work with a magnetic roller of a machine selected from the group consisting of copier, printer and facsimile machine, said strip comprising at least two layers, namely a first layer made at least partly of polyurethane, said first layer having a thickness of more than 100 $\mu$m and a resistivity of more than 10 $10^{14}$ $\Omega$ per square, and a second layer covering at least partly the said first layer and having a face adapted for contacting with interposition of toner particles a magnetic roller, said second layer made at least partly of polyurethane and conductive material having a thickness of less than 100 $\mu$m and an electrical surface resistivity of less than $10^{13}$ $\Omega$ per square.

47. The strip of claim 46, which comprises a second layer having an electrical surface resistivity comprised between $10^7$ and $10^{12}$ $\Omega$ per square.

48. The strip of claim 46, which comprises a second layer having an electrical surface resistivity comprised between $10^8$ and $10^{11}$ $\Omega$ per square.

49. The strip of claim 46, in which the second layer has a resistance against abrasion measured by the ASTM-1938 abrasion test of less than 0.1 g.

50. In a process for printing or copying a document by means of a printer, copier or facsimile machine, in which at least:

toner is transferred on a magnetic roller;

a doctor blade contacts said magnetic roller with interposition of toner particles for distributing toner on the magnetic roller;

toner distributed by the doctor blade of the magnetic roller is transferred on a charge sensible element, and toner transferred on the charge sensible element is transferred on a support, said process having the improvement that the doctor blade consists of at least a substrate provided with an element comprising at least two layers, namely a first layer made of elastic material having a thickness of more than 100 $\mu$m and a resistivity of more than 10 $10^{14}$ $\Omega$ per square, and a second layer covering at least partly the said first layer and having a face adapted for contacting with interposition of toner particles the magnetic roller, said second layer having a thickness of less than 100 $\mu$m and an electrical surface resistivity of less than $10^{13}$ $\Omega$ per square.

51. In the process of claim 50, the second layer has an electrical resistivity comprised between $10^7$ and $10^{12}$ $\Omega$ per square.

52. In the process of claim 50, the second layer has an electrical resistivity comprised between $10^8$ and $10^{11}$ per square.

53. In the process of claim 50, the second layer has a thickness of less than 50 $\mu$m.

54. In the process of claim 50, the second layer has a thickness comprised between 10 and 35 $\mu$m.

55. In the process of claim 50, the element is at least partly made of elastomer material.

56. In the process of claim 50, the substrate being a flexible substrate with a free end edge, said free end edge being at least covered by the said element.

57. In the process of claim 50, the substrate being a flexible substrate having a face on which the element is attached, the said face having a free end edge, while the element has an edge adjacent to the said free end edge of the substrate.

58. In the process of claim 50, the substrate being a flexible substrate having a face on which the element is attached, the said face having a free end edge, while the element has an edge adjacent to the said free end edge of the substrate, said edge being distant from the said free end edge of a distance of at least 50 $\mu$m.

59. In the process of claim 50, the face adapted for working with a magnetic roller and having an electrical surface resistivity of less than 9.9 $10^{14}$ $\Omega$ per square having a resistance against abrasion measured by the ASTM-1938 abrasion test of less than 0.1 g.

60. In the process of claim 50, the second layer has a resistance against abrasion measured by the ASTM-1938 abrasion test of less than 0.1 g.

61. In the process of claim 60, in which the doctor blade is not connected to a voltage applying means.

62. In a process for printing or copying a document by means of a printer, copier of facsimile machine, in which at least:

toner is transferred on a magnetic roller;

a doctor blade having a free end edge contacts said magnetic roller with interposition of toner particles for distributing toner on a magnetic roller;

toner distributed by the doctor blade of the magnetic roller is transferred on a charge sensible element, and toner transferred on the charge sensible element is transferred on a support, said process having the improvement that the doctor blade consists of at least a substrate provided with an element made at least partly of an elastic material, said element having at least partly a thickness of 100 $\mu$m and comprising a layer having a face adapted for contacting with interposition of toner particles a magnetic roller, said layer having an electrical surface resistivity of less 9.9 $10^{14}$ $\Omega$ per square, in which the element is distant from said free end edge of the substrate.

63. In the process of claim 62, in which the element has an edge adjacent to the free end edge of the substrate, said edge being distant from the free end edge of the substrate of a distance of at least 50 $\mu$m.

64. In the process of claim 62, in which the doctor blade is not connected to a voltage applying means.

65. In a process for printing or copying a document by means of a printer, copier or facsimile machine, in which at least:

toner is transferred on a magnetic roller;

a doctor blade contacts said magnetic roller with interposition of toner particles for distributing toner on the magnetic roller;

toner distributed by the doctor blade of the magnetic roller is transferred on a charge sensible element, and toner transferred on the charge sensible element is transferred on a support, said process having the improvement that the doctor blade consists of at least a substrate provided with an element comprising at least two layers, namely a first layer made at least partly of polyurethane, said first layer having a thickness of more than 100 $\mu$m and a resistivity of more than 10 $10^{14}$ $\Omega$ per square, and a second layer covering at least partly the said first layer and having a face adapted for contacting with interposition of toner particles a magnetic roller, said second layer made at least partly of polyurethane and conductive material having a thickness of less than 100 $\mu$m and an electrical surface resistivity of less than $10^{13}$ $\Omega$ per square.

66. In the process of claim 65, in which the second layer has a resistance against abrasion measured by the ASTM-1938 abrasion test of less than 0.1 g.

67. In the process of claim 65, in which the doctor blade is not connected to a voltage applying means.

68. A process for reconditioning a used doctor blade comprising a substrate, in which a strip made at least partly of an elastic material is glued on the substrate of the doctor blade, said strip comprising at least two layers, namely a first layer made of elastic material and provided with means for attaching it on a face of the substrate, said first layer having a thickness of more than 100 $\mu$m and a resistivity of more than 10 $10^{14}$ $\Omega$ per square, and a second layer covering at least partly the said first layer and having a face adapted for contacting with interposition of toner particles the magnetic roller, said second layer having a thickness of less than 100 $\mu$m and an electrical surface resistivity of less than $10^{13}$ $\Omega$ per square.

69. The process of claim 68, in which a part of the second layer has an electrical surface resistivity comprised between $10^7$ and $10^{12}$ $\Omega$ per square.

70. The process of claim 68, in which a part of the second layer has an electrical surface resistivity comprised between $10^8$ and $10^{11}$ per square.

71. The process of claim 68, in which the second layer has a thickness of less than 50 $\mu$m.

72. The process of claim 68, in which, prior to the gluing of the strip on the substrate of the doctor blade, the substrate having a shape distorted during its use is submitted to a heat treatment and to a pressure for restoring substantially the shape of the substrate of the doctor blade before its use.

73. The process of claim 68, in which, after gluing the strip on the substrate of a doctor blade, at least the substrate having a shape distorted during its use is submitted to a heat treatment and to a pressure for restoring substantially the shape of the substrate of the doctor blade before its use.

74. The process of claim 68, in which the second layer has a resistance against abrasion measured by the ASTM-1938 abrasion test of less than 0.1 g.

75. The process of claim 68, in which the first layer is provided with glue for attaching the strip on the substrate.

76. In the process of claim 68, in which the doctor blade is not connected to a voltage applying means.

77. A process for reconditioning a used doctor blade comprising a substrate, in which a strip made at least partly of an elastic material is glued on the substrate of the doctor blade, said strip comprising at least two layers, namely a first layer made at least partly of polyurethane, said first layer having a thickness of more than 100 $\mu$m and a resistivity of more than 10 $10^{14}$ $\Omega$ per square, and a second layer covering at least partly the said first layer and having a face adapted for contacting with interposition of toner particles a magnetic roller, said second layer made at least partly of polyurethane and conductive material having a thickness of less than 100 $\mu$m and an electrical surface resistivity of less than $10^{13}$ $\Omega$ per square.

78. The process of claim 71, in which the second layer has a thickness comprised between 10 and 35 $\mu$m.

79. A doctor blade consisting of at least a substrate provided with an element having a face adapted for contacting with interposition of toner particles a magnetic roller of a machine selected from the group consisting of copier, printer and facsimile machine, said element comprising at least two layers, namely:

a first layer made at least partly of polyurethane, said first layer having a thickness of more than 100 $\mu$m and a resistivity of more than 10 $10^{14}$ $\Omega$ per square, and a second layer covering at least partly the said first layer and having a face adapted for contacting with interposition of toner particles a magnetic roller, said second layer made at least partly of polyurethane and conductive material having a thickness of less than 100 $\mu$m and an electrical surface resistivity of less than $10^{13}$ $\Omega$ per square.

* * * * *